US008773035B2

(12) United States Patent
Wang et al.

(10) Patent No.: US 8,773,035 B2
(45) Date of Patent: Jul. 8, 2014

(54) ELECTRONIC BALLAST WITH REAL-TIME CURRENT CREST FACTOR IMPROVEMENT FUNCTION

(71) Applicant: Delta Electronics, Inc., Taoyuan Hsien (TW)

(72) Inventors: Chang-Ching Wang, Taoyuan Hsien (TW); Chin-Ho Chou, Taoyuan Hsien (TW); Chih Lo, Taoyuan Hsien (TW); Weng-Fatt Chan, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1 day.

(21) Appl. No.: 13/789,181

(22) Filed: Mar. 7, 2013

(65) Prior Publication Data

US 2014/0139127 A1 May 22, 2014

(30) Foreign Application Priority Data

Nov. 16, 2012 (TW) ..... 101142766 A

(51) Int. Cl.
*H05B 41/24* (2006.01)
*H05B 41/16* (2006.01)

(52) U.S. Cl.
CPC ..... *H05B 41/16* (2013.01); *Y10S 315/05* (2013.01)
USPC ..... 315/247; 315/209 R; 315/291; 315/307; 315/308; 315/DIG. 5

(58) Field of Classification Search
USPC ..... 315/200 R, 209 R, 224, 225, 247, 291, 315/307, 308, DIG. 5
See application file for complete search history.

(56) References Cited

U.S. PATENT DOCUMENTS

| | | | | |
|---|---|---|---|---|
| 7,312,582 | B2 * | 12/2007 | Newman et al. | 315/200 R |
| 7,365,499 | B2 * | 4/2008 | Nerone et al. | 315/247 |
| 7,944,156 | B2 * | 5/2011 | Quazi | 315/307 |
| 2006/0006818 | A1 * | 1/2006 | Fishbein et al. | 315/291 |

* cited by examiner

*Primary Examiner* — Douglas W Owens
*Assistant Examiner* — Thai Pham
(74) *Attorney, Agent, or Firm* — Kirton McConkie; Evan R. Witt

(57) ABSTRACT

An electronic ballast includes a converter, an inverter circuit, a controlling unit, and a current crest factor improvement circuit. The controlling unit issues a first control signal to control the converter and issues a second control signal and a third control signal with opposite enabling/disabling states to control on/off states of corresponding switch elements of the inverter circuit. During a dead time between the enabling state of second control signal and the enabling state of the third control signal, these switch elements are simultaneously in the off state. During the dead time, the current crest factor improvement circuit is triggered to generate a restraining signal. According to the restraining signal, an output power of the converter is decreased to a predetermined value in real time or the converter is suspended.

16 Claims, 6 Drawing Sheets

ELECTRONIC BALLAST WITH REAL-TIME CURRENT CREST FACTOR IMPROVEMENT FUNCTION

FIELD OF THE INVENTION

The present invention relates to an electronic ballast, and more particularly to an electronic ballast with a real-time current crest factor improvement function.

BACKGROUND OF THE INVENTION

As known, a gas discharge lamp has many benefits such as high brightness, long life, small volume, high lighting efficiency and good color rendering efficiency. Consequently, the gas discharge lamp is widely used in a variety of outdoor, indoor or automotive lighting devices. The gas discharge lamp is usually equipped with an electronic ballast for controlling the AC current that is outputted from the gas discharge lamp.

The conventional electronic ballast at least comprises a converter and an inverter circuit. The converter is controlled by a constant power control circuit. Consequently, the DC voltage received by the converter is converted into regulated DC voltages with different voltage levels. The constant power control circuit is also used for detecting a DC voltage and a DC current from the converter. According to the detecting result, the converter is controlled by the constant power control circuit to output a constant power. The inverter circuit is for example a full-bridge inverter circuit composed of four switch elements. Two switch elements at the upper bridge arm and two switch elements at the lower bridge arm are connected with each other in parallel. Under control of an inverter control circuit, the two switch elements at the upper bridge arm and the two switch elements at the lower bridge arm are alternately turned on or turned off. Consequently, the DC voltage and the DC current from the converter are converted into an AC voltage and an AC current, respectively.

As known, the simultaneous conduction of the two switch elements at the upper bridge arm or the simultaneous conduction of the two switch elements at the lower bridge arm may cause damage of the switch elements. For avoiding simultaneous conduction, after the on-state switch elements at the upper bridge arm and the lower bridge arm are switched to the off state for a certain time interval, the off-state switch elements at the upper bridge arm and the lower bridge arm will be switched to the on state. The certain time interval is also referred as a dead time. During the dead time, the two switch elements at the upper bridge arm and the two switch elements at the lower bridge arm are simultaneously in the off state. Moreover, an ignitor is connected between the inverter circuit and the gas discharge lamp for temporarily and largely increasing the voltage level of the AC output voltage from the inverter circuit, thereby driving illumination of the gas discharge lamp.

Since the operation of the gas discharge lamp is driven by the AC current from the electronic ballast, the quality of a current crest factor (CCF) of the AC current may directly influence the use life of the gas discharge lamp. FIG. 1 is a schematic timing waveform diagram illustrating the current of a gas discharge lamp driven by a conventional electronic ballast. During the polarity inversion of the AC current from the conventional electronic ballast, the inverter circuit is continuously operated to provide rated electric energy to the inverter circuit. Since the two switch elements at the upper bridge arm of the inverter circuit and the two switch elements at the lower bridge arm of the inverter circuit are simultaneously in the off state during the dead time, the output voltage from the inverter circuit is not generated during the dead time. Meanwhile, the electric energy outputted from the inverter circuit can be only stored in an output capacitor of the inverter circuit. After the transient polarity inversion of the output current from the electronic ballast, the predetermined electric energy from the inverter circuit and the electric energy stored in the output capacitor are simultaneously transmitted to the gas discharge lamp. Due to the transient high electric energy, the lamp current flowing through the gas discharge lamp may result in a peak current (see FIG. 1). The peak current also results in a peak voltage of the gas discharge lamp. Under this circumstance, the current crest factor is reduced, and thus the use life of the gas discharge lamp is shortened.

For solving the above drawbacks, the conventional electronic ballast may further comprise a detecting circuit for detecting whether the output current from the converter fluctuates. If the output current from the converter fluctuates, the detecting circuit issues a corresponding signal to reduce the output power of the converter in order to restrain the peak current. In other words, the conventional method of restraining the peak current is passively performed after the AC output current from the electronic ballast results in the peak current. Since the action of restraining the peak current is triggered when the peak current is generated, the peak current fails to be completely restrained and the efficacy of restraining the peak current is unsatisfactory. Moreover, since the detecting circuit needs to detect and judge current fluctuation, the computation is complicated and the circuitry configuration is costly.

Therefore, there is a need of providing an electronic ballast with a real-time current crest factor improvement function in order to eliminate the above drawbacks.

SUMMARY OF THE INVENTION

The present invention provides an electronic ballast with a real-time current crest factor improvement function. The electronic ballast has a current crest factor improvement circuit for receiving two control signals that are used to control the on/off states of corresponding switch elements of an inverter circuit. During a dead time between the enabling states of two control signals, a controlling unit may reduce the output power of the converter to a predetermined value in real time or suspend the converter. Consequently, the controlling unit of the electronic ballast can actively and immediately restrain generation of the peak current and the peak voltage. Under this circumstance, the use life and the power-saving efficacy of the gas discharge lamp will be enhanced. Moreover, the circuitry configuration of the electronic ballast of the present invention is simplified and cost-effective.

In accordance with an aspect of the present invention, there is provided an electronic ballast. The electronic ballast includes a converter, an inverter circuit, a controlling unit, and a current crest factor improvement circuit. The converter is used for providing a DC voltage. The inverter circuit is connected with the converter for converting the DC voltage into an AC output voltage, so that at least one gas discharge lamp is driven by electric energy of the AC output voltage. The inverter circuit includes plural switch elements. The controlling unit is connected with the converter and the plural switch elements of the inverter circuit. The controlling unit issues a first control signal to control the converter and issues a second control signal and a third control signal with opposite enabling/disabling states to control on/off states of corresponding switch elements. During a dead time between the enabling state of second control signal and the enabling state of the third control signal, the plural switch elements are simultaneously in the off state. The current crest factor improvement circuit is connected with the controlling unit for receiving the second control signal and the third control signal. During the dead time, the current crest factor improvement circuit is triggered to generate a restraining signal to the controlling unit. According to the restraining signal, the first control signal is correspondingly adjusted by the controlling unit, so that an output power of the converter is decreased to a predetermined value in real time or the converter is suspended.

In accordance with another aspect of the present invention, there is provided an electronic ballast. The electronic ballast includes a converter, an inverter circuit, and a controlling unit. The converter is used for providing a DC voltage. The inverter circuit is connected with the converter for converting the DC voltage into an AC output voltage, so that at least one gas discharge lamp is driven by electric energy of the AC output voltage. The inverter circuit includes plural switch elements. The controlling unit is connected with the converter and the plural switch elements of the inverter circuit. The controlling unit issues a first control signal to control the converter and issues a second control signal and a third control signal with opposite enabling/disabling states to control on/off states of corresponding switch elements. During a dead time between the enabling state of second control signal and the enabling state of the third control signal, the plural switch elements are simultaneously in the off state. During the dead time, the first control signal is correspondingly adjusted by the controlling unit, wherein according to the adjusted first control signal, an output power of the converter is decreased to a predetermined value in real time or the converter is suspended.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
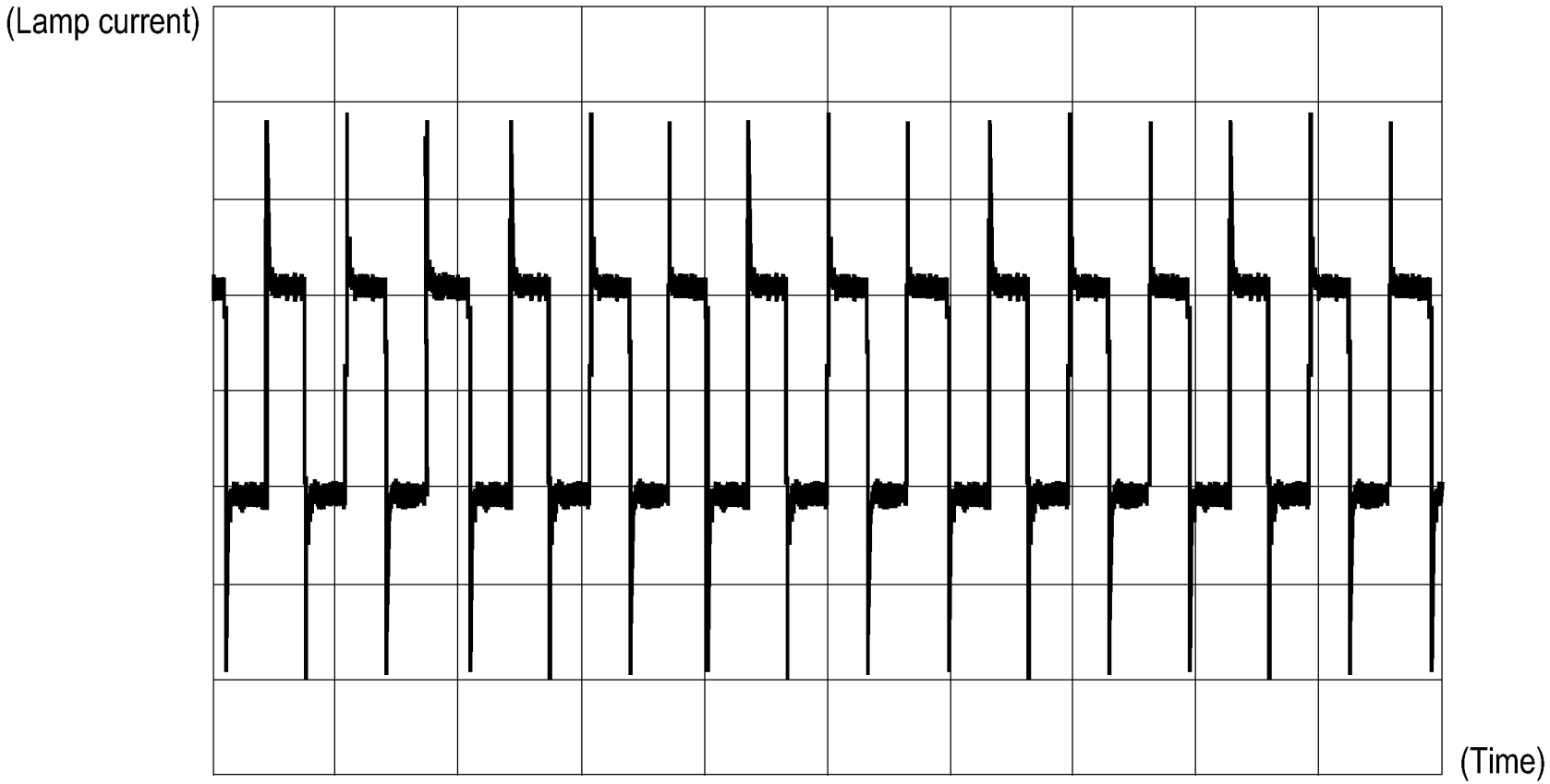
FIG. 1 PRIOR ART
FIG. 1 is a schematic timing waveform diagram illustrating the current of a gas discharge lamp driven by a conventional electronic ballast.
Figure 2:
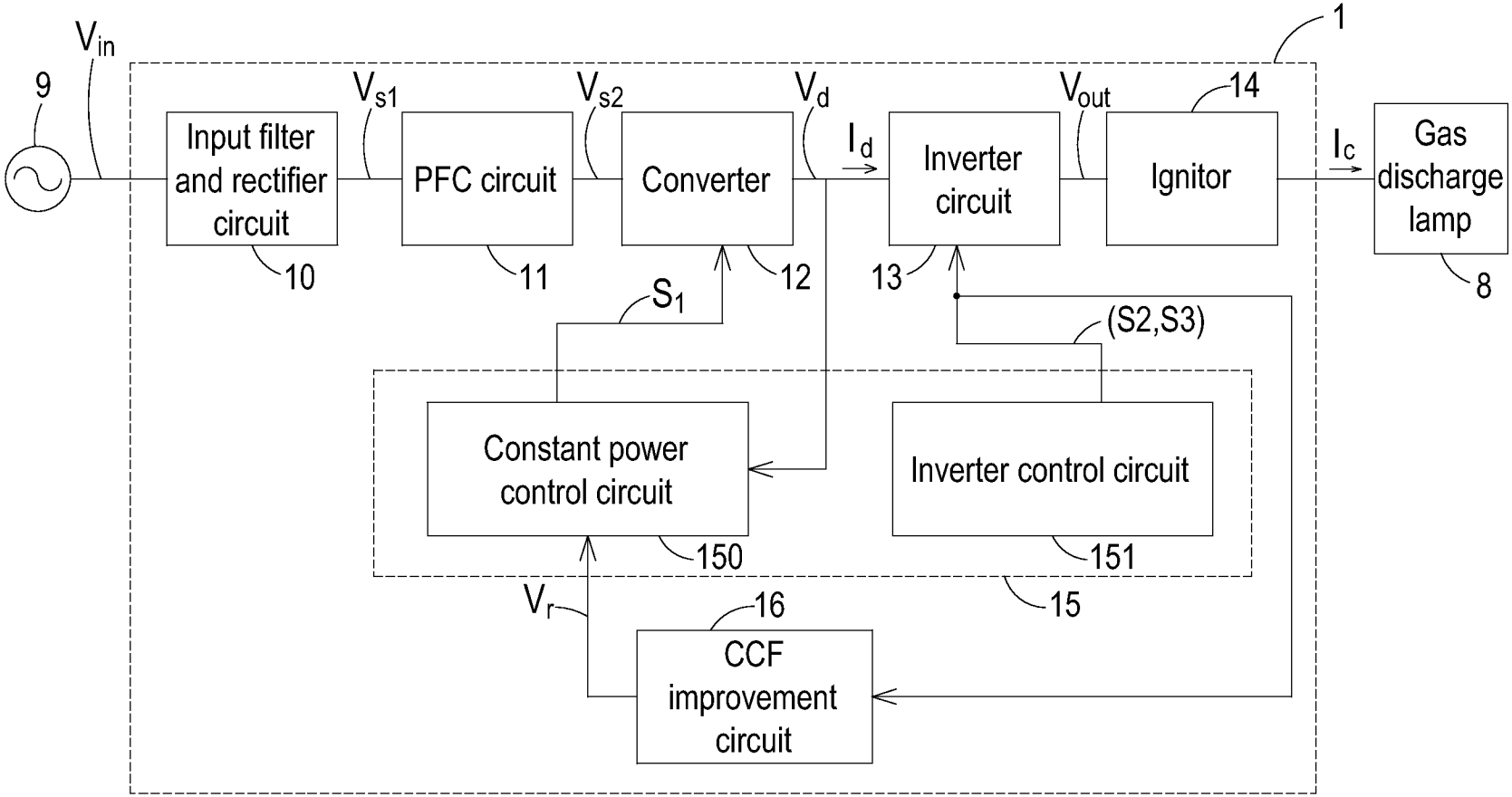
FIG. 2 is a schematic circuit block diagram illustrating an electronic ballast according to an embodiment of the present invention.
Figure 3:
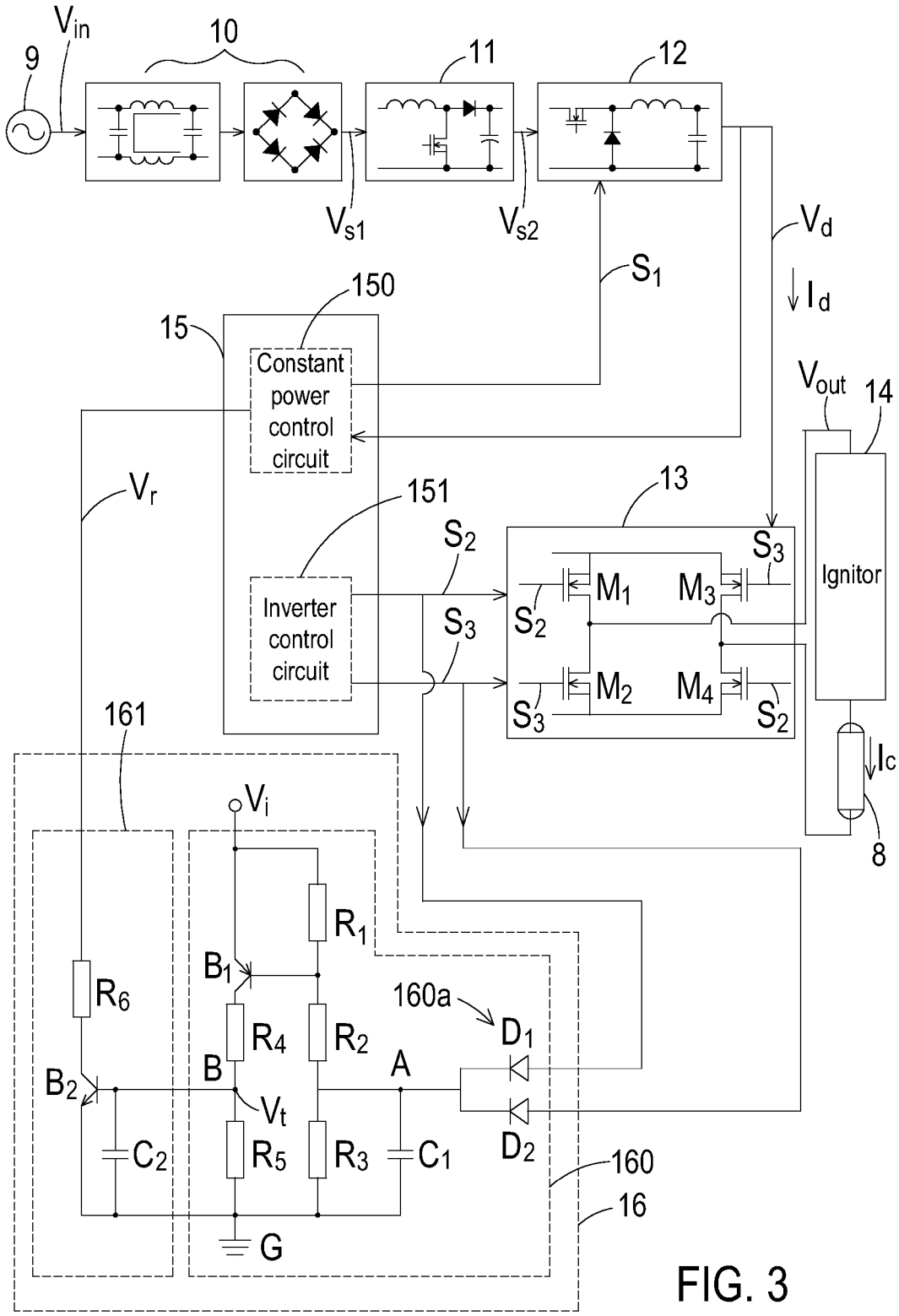
FIG. 3 is a schematic circuit diagram illustrating the detailed circuitry of the electronic ballast of FIG. 2.

FIG. 2 is a schematic circuit block diagram illustrating an electronic ballast according to an embodiment of the present invention. FIG. 3 is a schematic circuit diagram illustrating the detailed circuitry of the electronic ballast of FIG. 2. As shown in FIGS. 2 and 3, the electronic ballast 1 is electrically connected with an AC input power source 9 (e.g. a utility power source) and at least one gas discharge lamp 8. After an AC input voltage $V_{in}$ is received, the AC input voltage $V_{in}$ is converted by the electronic ballast 1 into electric energy for illumination and operation of the gas discharge lamp 8. The electronic ballast 1 comprises an input filter and rectifier circuit 10, a power factor correction (PFC) circuit 11, a converter 12, an inverter circuit 13, an ignitor 14, a controlling unit 15, and a current crest factor (CCF) improvement circuit 16.

The input filter and rectifier circuit 10 is connected with an input terminal of the electronic ballast 1, and electrically connected with the AC input power source 9. The input filter and rectifier circuit 10 is used for isolating the high-frequency noise of the electronic ballast 1 and the external noise of the AC input voltage $V_{in}$ in order to reduce the interference therebetween. Moreover, the input filter and rectifier circuit 10 is also used for rectifying the AC input voltage $V_{in}$ into a full-wave rectified DC voltage $V_{s1}$. The PFC circuit 11 is connected with the input filter and rectifier circuit 10. In this embodiment, the PFC circuit 11 has a boost-type circuitry configuration. By alternately turning on and turning off a switch element (not shown) of the PFC circuit 11, the distribution and envelop curve of an input current (not shown) received by the input terminal of the electronic ballast 1 becomes similar to the waveform of the AC input voltage $V_{in}$. Consequently, the power factor is increased, and the full-wave rectified DC voltage $V_{s1}$ is converted into a high DC voltage $V_{s2}$, wherein the high DC voltage $V_{s2}$ is higher than the full-wave rectified DC voltage $V_{s1}$.

As shown in FIG. 3, the converter 12 is connected with the PFC circuit 11 and the controlling unit 15. The converter 12 is a buck converter. By alternately turning on and turning off a switch element (not shown) of the converter 12, the high DC voltage $V_{s2}$ is converted into a low DC voltage $V_d$, wherein the low DC voltage $V_d$ is lower than the high DC voltage $V_{s2}$. The buck converter 12 of FIG. 3 is presented herein for purpose of illustration and description only. Those skilled in the art will readily observe that numerous modifications and alterations may be made while retaining the teachings of the invention. For example, the converter 12 with the buck-type circuitry configuration may be a buck-boost converter or a non-isolated buck converter.

The inverter circuit 13 is connected with the converter 12 and the controlling unit 15. The inverter circuit 13 is a full-bridge circuit composed of four switch elements such as metal-oxide-semiconductor field-effect transistors. For example, these switch elements comprise a first switch element $M_1$, a second switch element $M_2$, a third switch element $M_3$ and a fourth switch element $M_4$. The first switch element $M_1$ and second switch element $M_2$ at the upper bridge arm are connected with each other in series. The third switch element $M_3$ and the fourth switch element $M_4$ at the lower bridge arm are connected with each other in series. Moreover, the upper bridge arm and the lower bridge arm are connected with each other in parallel. The first switch element $M_1$ and second switch element $M_2$ at the upper bridge arm are controlled by the controlling unit 15 to be alternatively turned on or turned off. The third switch element $M_3$ and the fourth switch element $M_4$ at the lower bridge arm are also controlled by the controlling unit 15 to be alternatively turned on or turned off. The switching operations of the upper bridge arm and the lower bridge arm are performed synchronously. In other words, by switching the four switch elements $M_1$~$M_4$, the low DC voltage $V_d$ is converted into an AC output voltage Vout for providing an electric energy to illuminate the gas discharge lamp 8. It is noted that the configuration of the inverter circuit 13 may be varied according to the practical requirements. For example, in some other embodiments, the inverter circuit 13 is a half-bridge circuit composed of two switch elements (not shown).

The ignitor 14 is connected between the inverter circuit 13 and the gas discharge lamp 8 for temporarily increasing the voltage level of the output voltage $V_{out}$ to about 3~5 KV, thereby driving illumination of the gas discharge lamp 8.

The controlling unit 15 is connected with the converter 12 and the inverter circuit 13 for controlling operations of the converter 12 and the inverter circuit 13. In this embodiment, the controlling unit 15 comprises a constant power control circuit 150 and an inverter control circuit 151. The constant power control circuit 150 is electrically connected with the switch element of the converter 12. The constant power control circuit 150 is used for outputting a first control signal $S_1$, which is a pulse width modulation (PWM) signal. According to the first control signal $S_1$, the switching action of the switch element of the converter 12 is correspondingly controlled. Consequently, the high DC voltage $V_{s2}$ is converted into the low DC voltage $V_d$ by the converter 12. Alternatively, in some other embodiments, the constant power control circuit 150 is further connected with an output terminal of the converter 12 for detecting the low DC voltage $V_d$ and a working DC current Id from the converter 12. According to the low DC voltage $V_d$ and a working DC current $I_d$, the first control signal $S_1$ is adjusted by the constant power control circuit 150. Consequently, the converter 12 is controlled to output a constant power.

Figure 4:
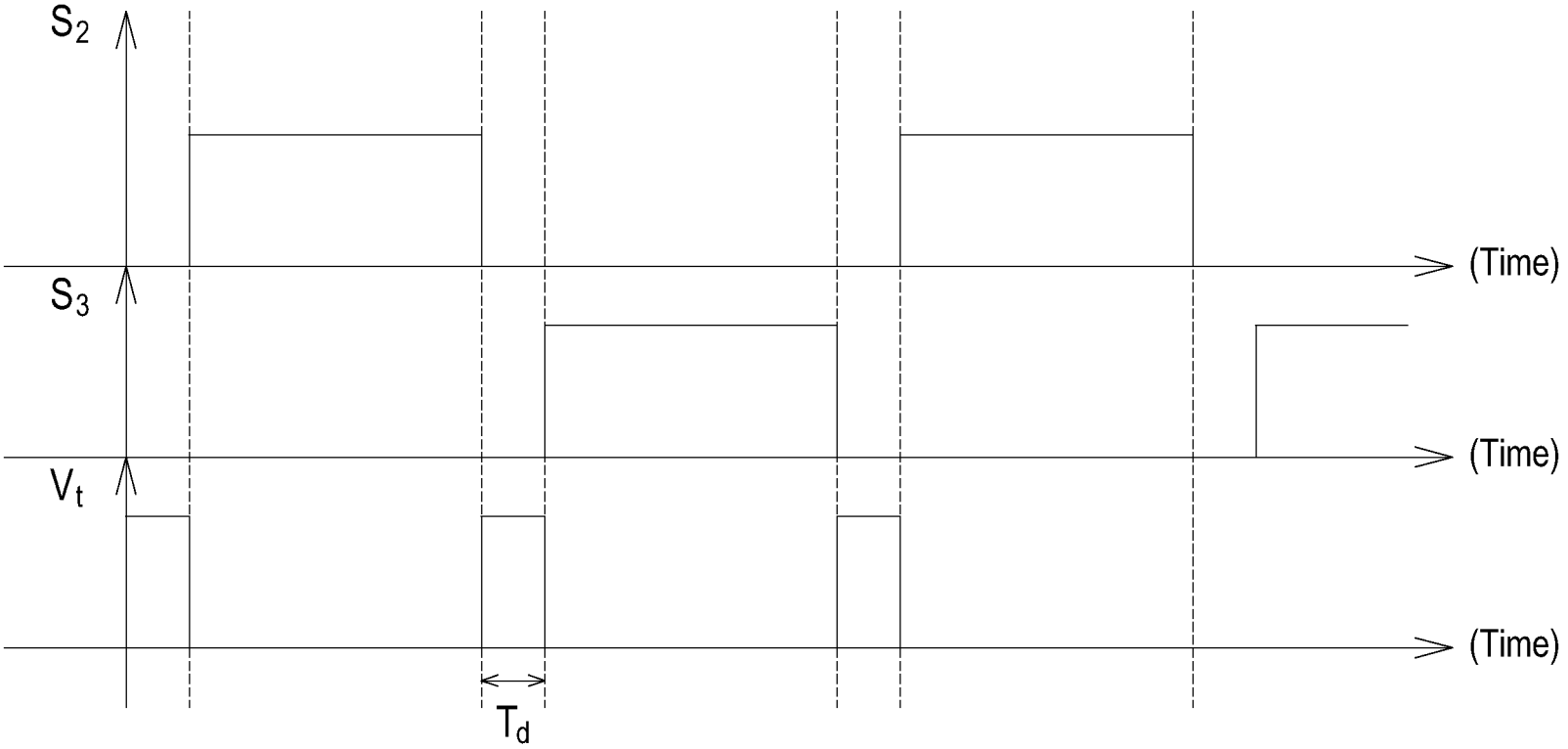
FIG. 4 is a schematic timing waveform diagram illustrating a second control signal and a third control signal of the electronic ballast of FIG. 3.

FIG. 4 is a schematic timing waveform diagram illustrating a second control signal and a third control signal of the electronic ballast of FIG. 3. Please refer to FIGS. 2, 3 and 4. The inverter control circuit 151 is connected with the control terminals of the four switch elements $M_1$-$M_4$ of the inverter circuit 13. The inverter control circuit 151 is used for issuing a second control signal $S_2$ (e.g. a PWM signal) to the control terminals of the first switch element $M_1$ and the fourth switch element $M_4$, thereby controlling the same switching action of the first switch element $M_1$ and the fourth switch element $M_4$. The inverter control circuit 151 is also used for issuing a third control signal $S_3$ (e.g. a PWM signal) to the control terminals of the second switch element $M_2$ and the third switch element $M_3$, thereby controlling the same switching action of the second switch element $M_2$ and the third switch element $M_3$.

As shown in FIG. 4, under control of the inverter control circuit 151, the second control signal $S_2$ and the third control signal $S_3$ have opposite enabling/disabling states. Since the second control signal $S_2$ is received by the first switch element $M_1$ and the fourth switch element $M_4$ and the third control signal $S_3$ is received by the second switch element $M_2$ and the third switch element $M_3$, the switch elements $M_1$, $M_4$ are alternately turned on or turned off and the switch elements $M_2$, $M_3$ are alternately turned on or turned off. Moreover, under control of the inverter control circuit 151, there is a dead time $T_d$ between the enabling state of the second control signal $S_2$ and the enabling state of the third control signal $S_3$. During the dead time $T_d$, both of the second control signal $S_2$ and the third control signal $S_3$ are in the low-level state (i.e. disabling state), and these switch elements $M_1$~$M_4$ are in the off state. Consequently, the first switch element $M_1$ and the second switch element $M_2$ are not simultaneously turned on, and the third switch element $M_3$ and the fourth switch element $M_4$ are not simultaneously turned on. The dead time $T_d$ is a time period of a polarity inversion of the AC output voltage $V_{out}$ from the inverter circuit 13.

In some embodiments, the controlling unit 15 is implemented by a monolithic integrated circuit such as an IRS2573D integrated circuit. The monolithic integrated circuit may have both functions of the constant power control circuit 150 and the inverter control circuit 151. Consequently, only a single integrated circuit can implement of the functions of the constant power control circuit 150 and the inverter control circuit 151.

The current crest factor improvement circuit 16 is connected with the inverter control circuit 151 for receiving the second control signal $S_2$ and the third control signal $S_3$. The current crest factor improvement circuit 16 is also connected with the constant power control circuit 150. During the dead time $T_d$ between the enabling state of the second control signal $S_2$ and the enabling state of the third control signal $S_3$, the current crest factor improvement circuit 16 is triggered to generate a restraining signal $V_r$ to the constant power control circuit 150. According to the restraining signal $V_r$, the first control signal $S_1$ is correspondingly adjusted by the constant power control circuit 150. According to the adjusted first control signal $S_1$, the converter 12 is controlled to decrease the output power to a predetermined value (e.g. 50% reduction of the output power) in real time or suspend the converter 12. Under this circumstance, during the polarity inversion of the AC output voltage $V_{out}$ from the inverter circuit 13, the lamp current $I_c$ flowing through the gas discharge lamp 8 is less prone to generation of the peak current and the peak voltage, and thus the current crest factor is improved.

As previously described in the prior art, the peak current and the peak voltage occur during the dead time, i.e. the polarity inversion of the output voltage from the electronic ballast when the plural switch elements are simultaneously in the off state. In accordance with the present invention, the current crest factor improvement circuit 16 is triggered to generate a restraining signal $V_r$ to the constant power control circuit 150 during the dead time $T_d$. Consequently, during the transient polarity inversion of the output voltage from the electronic ballast 1, the controlling unit 15 may control the converter 12 to decrease the output power to the predetermined value in real time or suspend the converter 12. In other words, since the switch elements $M_1$~$M_4$ are in the off state and the output voltage from the inverter circuit 13 is not generated during the dead time, the output electric energy is reduced or not generated. After the transient polarity inversion of the output voltage from the electronic ballast 1, the converter 12 cannot output high electric energy, so that the current crest factor is improved.

Please refer to FIG. 3 again. The current crest factor improvement circuit 16 comprises a dead-time signal catch circuit 160 and a power restraining circuit 161. The dead-time signal catch circuit 160 is connected with the inverter control circuit 151 for receiving the second control signal $S_2$ and the third control signal $S_3$. During the dead time $T_d$ between the enabling state of the second control signal $S_2$ and the enabling state of the third control signal $S_3$, the dead-time signal catch circuit 160 is triggered to generate a triggering signal $V_t$. The power restraining circuit 161 is connected with the dead-time signal catch circuit 160 and the constant power control circuit 150. In response to the triggering signal $V_t$, the power restraining circuit 161 generates the restraining signal $V_r$ to the constant power control circuit 150. According to the restraining signal $V_r$, the first control signal $S_1$ is correspondingly adjusted by the constant power control circuit 150. According to the adjusted first control signal $S_1$, the converter 12 is controlled to decrease the output power to the predetermined value (e.g. 50% reduction of the output power) in real time or suspend the converter 12.

In an embodiment, the dead-time signal catch circuit 160 comprises an AND gate circuit 160*a* (i.e. composed of a first diode $D_1$ and a second diode $D_2$), a first capacitor $C_1$, a first resistor $R_1$, a second resistor $R_2$, a third resistor $R_3$, a fourth resistor $R_4$, a fifth resistor $R_5$, and a first transistor $B_1$ (e.g. a PNP bipolar junction transistor). The anode of the first diode $D_1$ is connected with the inverter control circuit 151 through a first input terminal of the dead-time signal catch circuit 160, so that the second control signal $S_2$ is received by the anode of the first diode $D_1$. The anode of the second diode $D_2$ is connected with the inverter control circuit 151 through a second input terminal of the dead-time signal catch circuit 160, so that the third control signal $S_3$ is received by the anode of the second diode $D_2$. The cathode of the first diode $D_1$ and the cathode of the second diode $D_2$ are connected with a first node A. The first capacitor $C_1$ is connected between the first node A and a ground terminal G. A first end of the first resistor $R_1$ is connected with an external voltage $V_i$. A second end of the first resistor $R_1$ is connected with a first end of the second resistor $R_2$. A second end of the second resistor $R_2$ is connected with a first end of the third resistor $R_3$ and the first node A. A second end of the third resistor $R_3$ is connected with the ground terminal G. The first resistor $R_1$, the second resistor $R_2$ and the third resistor $R_3$ are collaboratively defined as a first voltage divider. The third resistor $R_3$ is connected with the first capacitor $C_1$ in parallel, thereby providing a discharging path of the first capacitor $C_1$. The base of the PNP bipolar junction transistor $B_1$ is connected with the second end of the first resistor $R_1$ and the first end of the second resistor $R_2$. The emitter of the PNP bipolar junction transistor $B_1$ is connected with the first end of the first resistor $R_1$ and the external voltage $V_i$. The collector of the PNP bipolar junction transistor $B_1$ is connected with a first end of the fourth resistor $R_4$. A second end of the fourth resistor $R_4$, a first end of the fifth resistor $R_5$ and an output terminal of the dead-time signal catch circuit 160 are connected with a second node B. A second end of the fifth resistor $R_5$ is connected with the ground terminal G.

The power restraining circuit 161 comprises a second capacitor $C_2$, a sixth resistor $R_6$ and a second transistor $B_2$ (e.g. an NPN bipolar junction transistor). A first end of the second capacitor $C_2$ is connected with the output terminal of the dead-time signal catch circuit 160, the second end of the fourth resistor $R_4$ and the first end of the fifth resistor $R_5$ through the input terminal of the power restraining circuit 161. A second end of the second capacitor $C_2$ is connected with the ground terminal G. The fifth resistor $R_5$ is connected with the second capacitor $C_2$ in parallel, thereby providing a discharging path of the second capacitor $C_2$. The base of the NPN bipolar junction transistor $B_2$ is connected with a first end of the second capacitor $C_2$, and connected with the output terminal of the dead-time signal catch circuit 160, the second end of the fourth resistor $R_4$ and the first end of the fifth resistor $R_5$ through the input terminal of the power restraining circuit 161. That is, the base of the NPN bipolar junction transistor $B_2$ is connected with the second node B. The emitter of the NPN bipolar junction transistor $B_2$ is connected with the ground terminal G. The collector of the NPN bipolar junction transistor $B_2$ is connected with a first end of the sixth resistor $R_6$. A second end of the sixth resistor $R_6$ is connected with the constant power control circuit 150 of the controlling unit 15 through an output terminal of the power restraining circuit 161. By setting the resistance value of the sixth resistor $R_6$, the magnitude of the restraining signal $V_r$ provided to the constant power control circuit 150 is correspondingly adjusted.

Hereinafter, the operations of the current crest factor improvement circuit 16 of the electronic ballast 1 will be illustrated with reference to FIG. 4 as well as FIGS. 2 and 3. Before or after the dead time, the second control signal $S_2$ and the third control signal $S_3$ have opposite enabling/disabling states. Meanwhile, either the second control signal $S_2$ or the third control signal $S_3$ has an enabling level (e.g. 15V). The electric energy of the second control signal $S_2$ or the third control signal $S_3$ is transmitted to the first node A through the first diode $D_1$ or the second diode $D_2$ of the AND gate circuit 160*a* of the dead-time signal catch circuit 160. Consequently, the voltage at the first node A is about 15V through the first capacitor $C_1$. Through the first voltage divider (i.e. composed of the first resistor $R_1$, the second resistor $R_2$ and the third resistor $R_3$), the voltage at the first node A is transmitted to the base of the PNP bipolar junction transistor $B_1$. Since the different between the external voltage V, received by the emitter of the PNP bipolar junction transistor $B_1$ and the voltage at the base of the PNP bipolar junction transistor $B_1$ is lower than a threshold voltage of the PNP bipolar junction transistor $B_1$, the PNP bipolar junction transistor $B_1$ is turned off. Under this circumstance, the dead-time signal catch circuit 160 does not issue or stop issuing the triggering signal V, to the base of the NPN bipolar junction transistor $B_2$ of the power restraining circuit 161. Meanwhile, the voltage difference between the base and the emitter of the NPN bipolar junction transistor $B_2$ is lower than the threshold voltage of the NPN bipolar junction transistor $B_2$, so that the NPN bipolar junction transistor $B_2$ is also turned off. Under this circumstance, the NPN bipolar junction transistor $B_2$ does not issue the restraining signal $V_r$ to the constant power control circuit 150. Meanwhile, the converter 12 is controlled by the constant power control circuit 150 to output the constant power.

On the other hand, during the dead time between the enabling state of the second control signal $S_2$ and the enabling state of the third control signal $S_3$, both of the second control signal $S_2$ and the third control signal $S_3$ have a disabling level (e.g. 0V). Meanwhile, the first diode $D_1$ and the second diode $D_2$ of the AND gate circuit 160*a* of the dead-time signal catch circuit 160 are shut off. Consequently, the voltage at the first node A is decreased. Through the first voltage divider (i.e. composed of the first resistor $R_1$, the second resistor $R_2$ and the third resistor $R_3$), the voltage at the first node A is transmitted to the base of the PNP bipolar junction transistor $B_1$. Since the different between the external voltage V, received by the emitter of the PNP bipolar junction transistor $B_1$ and the voltage at the base of the PNP bipolar junction transistor $B_1$ is higher than the threshold voltage of the PNP bipolar junction transistor $B_1$, the PNP bipolar junction transistor $B_1$ is turned on. Under this circumstance, the electric energy of the external voltage $V_i$ is transmitted to a second voltage divider (i.e. composed of the fourth resistor $R_4$ and the fifth resistor $R_5$) through the on-state PNP bipolar junction transistor $B_1$, and then transmitted to the second node B (i.e. the output terminal of the dead-time signal catch circuit 160) through the second voltage divider. Meanwhile, the output terminal of the dead-time signal catch circuit 160 issues a triggering voltage $V_t$ (e.g. 5V) to the base of the NPN bipolar junction transistor $B_2$. Meanwhile, the voltage difference between the base and the emitter of the NPN bipolar junction transistor $B_2$ is higher than the threshold voltage of the NPN bipolar junction transistor $B_2$, so that the NPN bipolar junction transistor $B_2$ is also turned on. Under this circumstance, the output terminal of the power restraining circuit 161 is electrically connected with the ground terminal G through the sixth resistor $R_6$ and the on-state NPN bipolar junction transistor $B_2$. Since the output terminal of the power restraining circuit 161 is electrically connected with the ground terminal G, the output terminal of the power restraining circuit 161 issues a restraining signal $V_r$ with a zero voltage. According to the restraining signal $V_r$, the first control signal $S_1$ is correspondingly adjusted by the controlling unit 15, so that the output power of the converter 12 is decreased to a predetermined value in real time or the converter 12 is suspended.

Figure 5:
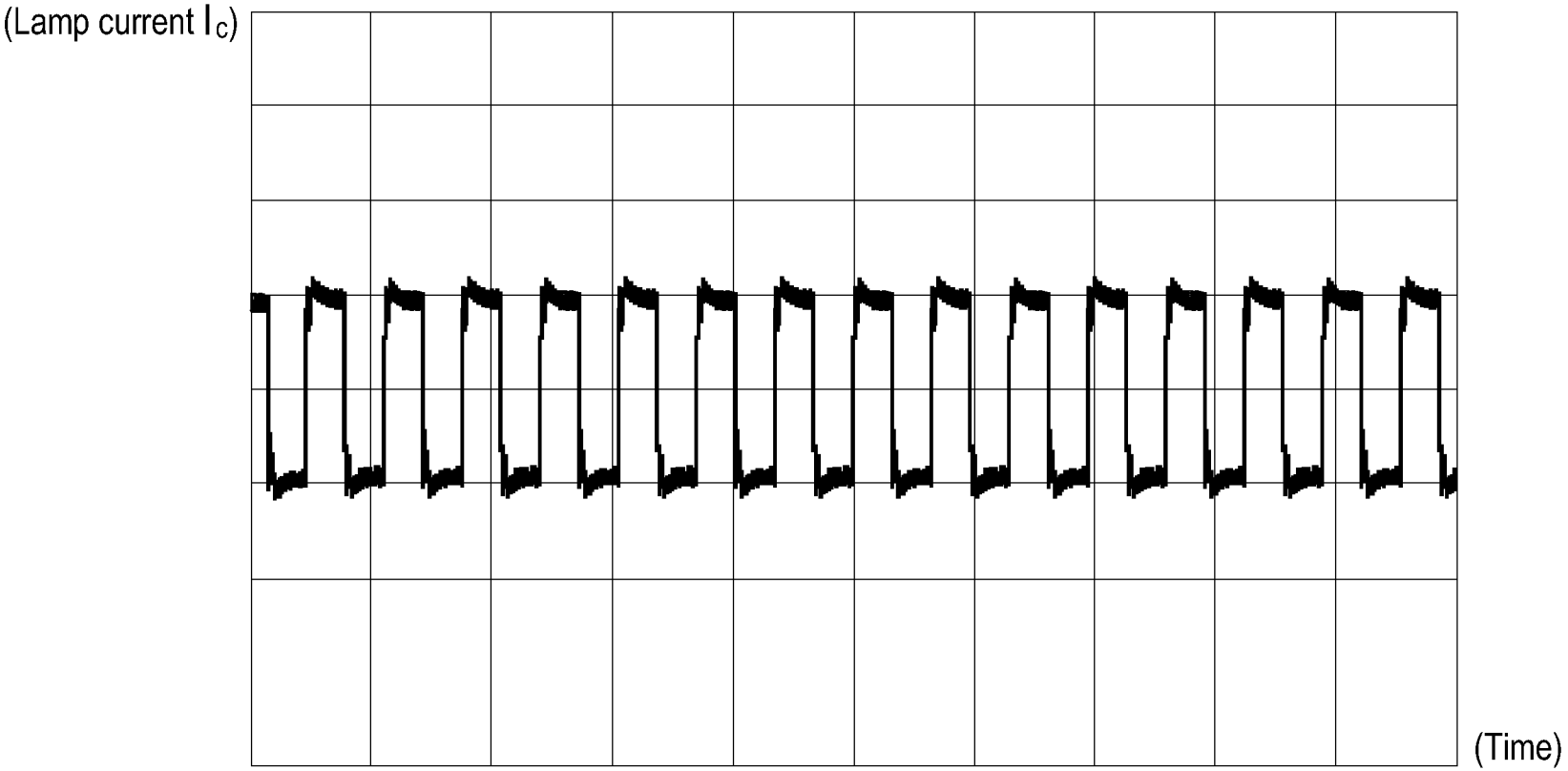
FIG. 5 is a schematic timing waveform diagram illustrating the current of the gas discharge lamp driven by the electronic ballast of the first embodiment of the present invention.

FIG. 5 is a schematic timing waveform diagram illustrating the current of the gas discharge lamp driven by the electronic ballast of the first embodiment of the present invention. As shown in FIG. 5, during the polarity inversion, the lamp current $I_c$ provided by the electronic ballast to the gas discharge lamp 8 does not result in the peak current and the peak voltage. Consequently, the current crest factor is improved.

Figure 6:
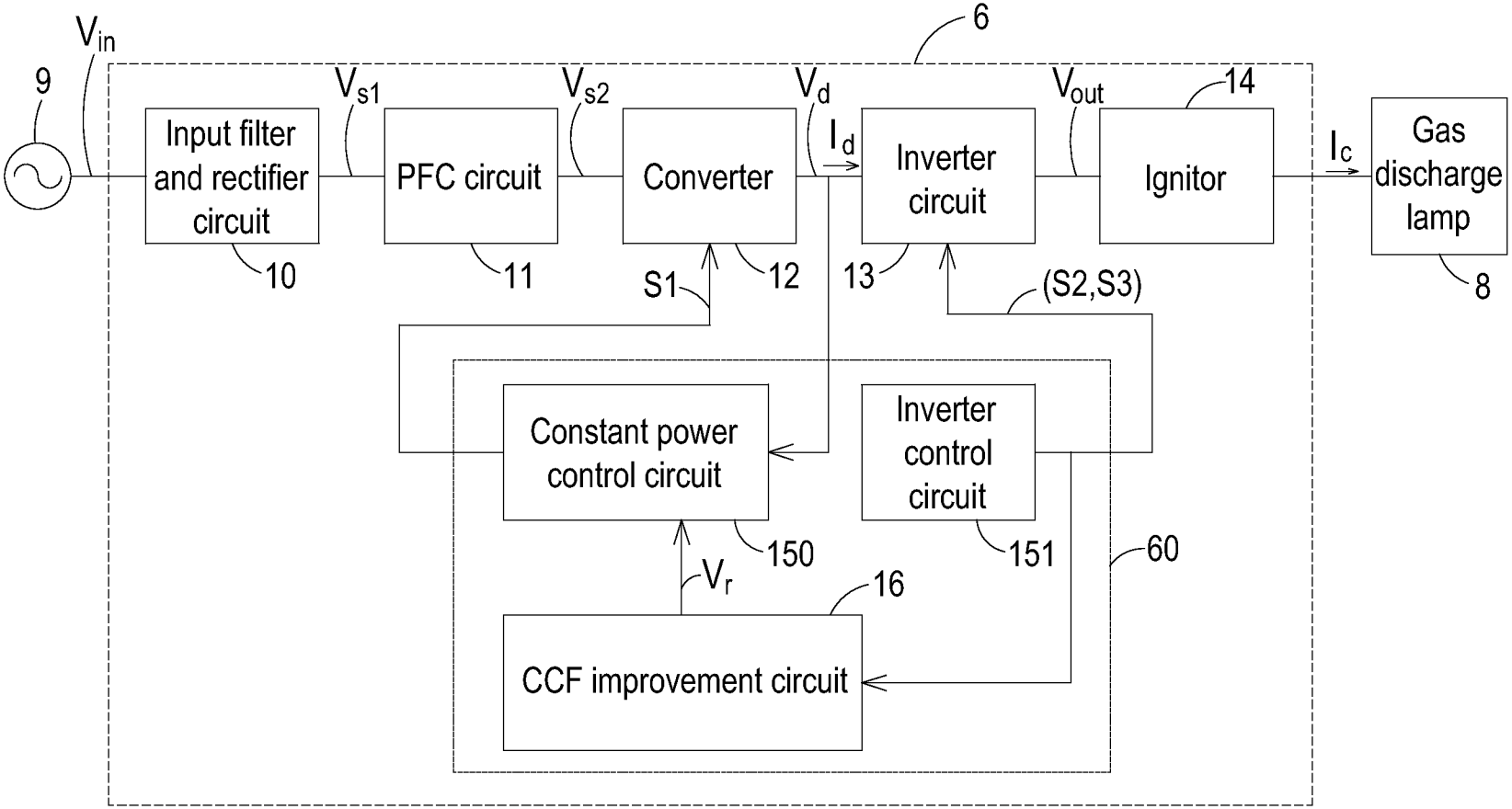
FIG. 6 is a schematic circuit block diagram illustrating an electronic ballast according to another embodiment of the present invention.

FIG. 6 is a schematic circuit block diagram illustrating an electronic ballast according to another embodiment of the present invention. The elements of the electronic ballast 6 corresponding to those of FIG. 2 will be designated by identical numeral references. In the electronic ballast 6 of this embodiment, the constant power control circuit 150, the inverter control circuit 151 and the current crest factor improvement circuit 16 are integrated into a controlling unit 60. For example, the controlling unit 60 is a microcontroller unit (MCU). The inverter control circuit 151 of the controlling unit 60 is used for issuing the second control signal $S_2$ and the third control signal $S_3$ to the switch elements $M_1$~$M_4$ of the inverter circuit 13 (see FIG. 3). The second control signal $S_2$ and the third control signal $S_3$ have opposite enabling/disabling states, and there is a dead time $T_d$ between the enabling state of the second control signal $S_2$ and the enabling state of the third control signal $S_3$ (see FIG. 4). During the dead time $T_d$, the current crest factor improvement circuit 16 is immediately triggered to generate a restraining signal V, to the constant power control circuit 150. According to the restraining signal $V_r$, the first control signal $S_1$ is correspondingly adjusted by the constant power control circuit 150. According to the adjusted first control signal $S_1$, the output power of the converter 12 is decreased to a predetermined value in real time, or the converter 12 is suspended. In comparison with the electronic ballast 1 of FIG. 2, the electronic ballast 6 is capable of restraining the peak current or the peak voltage earlier and faster.

From the above descriptions, the present invention provides an electronic ballast with a real-time current crest factor improvement function. The electronic ballast has a current crest factor improvement circuit for receiving two control signals. The two control signals are used to control the on/off states of corresponding switch elements of an inverter circuit. During a dead time between the enabling states of the two control signals, the controlling unit may reduce the output power of the converter to a predetermined value in real time or suspend the converter. Consequently, the controlling unit of the electronic ballast can actively and immediately restrain generation of the peak current and the peak voltage. Under this circumstance, the use life and the power-saving efficacy of the gas discharge lamp will be enhanced. Moreover, since the controlling unit reduces the output power of the converter to the predetermined value in real time or suspends the converter during the dead time, the electronic ballast does not need complicated circuitry configuration and complicated computation to judge whether the current from the converter fluctuates. In other words, the circuitry configuration of the electronic ballast of the present invention is simplified and cost-effective. Moreover, by the electronic ballast of the present invention, the speed of restraining the peak current is increased.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic ballast, comprising:

a converter for providing a DC voltage;

an inverter circuit connected with said converter for converting said DC voltage into an AC output voltage, so that at least one gas discharge lamp is driven by electric energy of said AC output voltage, wherein said inverter circuit comprises plural switch elements;

a controlling unit connected with said converter and said plural switch elements of said inverter circuit, wherein said controlling unit issues a first control signal to control said converter and issues a second control signal and a third control signal with opposite enabling/disabling states to control on/off states of corresponding switch elements, wherein during a dead time between said enabling state of second control signal and said enabling state of said third control signal, said plural switch elements are simultaneously in said off state; and a current crest factor improvement circuit connected with said controlling unit for receiving said second control signal and said third control signal, wherein during said dead time, said current crest factor improvement circuit is triggered to generate a restraining signal to said controlling unit, wherein according to said restraining signal, said first control signal is correspondingly adjusted by said controlling unit, so that an output power of said converter is decreased to a predetermined value in real time or said converter is suspended.

2. The electronic ballast according to claim 1, wherein said electronic ballast further comprises an input filter and rectifier circuit for filtering and rectifying said AC input voltage, thereby outputting a full-wave rectified DC voltage.

3. The electronic ballast according to claim 2, wherein said electronic ballast further comprises a power factor correction circuit, wherein said power factor correction circuit is connected between said input filter and rectifier circuit and said converter for increasing a power factor.

4. The electronic ballast according to claim 1, wherein said converter is a buck converter.

5. The electronic ballast according to claim 1, wherein said inverter circuit is a full-bridge inverter circuit.

6. The electronic ballast according to claim 1, wherein said current crest factor improvement circuit comprises:

a dead-time signal catch circuit connected with said controlling unit for receiving said second control signal and said third control signal, wherein during said dead time, said dead-time signal catch circuit is triggered to generate a triggering signal; and a power restraining circuit connected with said controlling unit and said dead-time signal catch circuit, wherein in response to said triggering signal, said power restraining circuit generates said restraining signal to said controlling unit.

7. The electronic ballast according to claim 6, wherein said dead-time signal catch circuit comprises:

a first diode, wherein an anode of said first diode is connected with said controlling unit for receiving said second control signal; and a second diode, wherein an anode of said second diode is connected with said controlling unit for receiving said third control signal, wherein a cathode of said first diode and a cathode of said second diode are connected with a first node.

8. The electronic ballast according to claim 7, wherein said dead-time signal catch circuit further comprises:

a first capacitor connected between said first node and a ground terminal;

a first resistor having a first end connected with an external voltage;

a second resistor having a first end connected with a second end of said first resistor, and having a second end connected with said first node;

a third resistor having a first end connected with a second end of said second resistor and said first node, and having a second end connected with said ground terminal;

a PNP bipolar junction transistor having a base connected with said first resistor and said second resistor, and having an emitter connected with said external voltage;

a fourth resistor having a first end connected with a collector of said PNP bipolar junction transistor; and a fifth resistor having a first end connected with a second end of said fourth resistor and a second end, and having a second end connected with said ground terminal.

9. The electronic ballast according to claim 8, wherein during said dead time, said first diode and said second diode are in said off state, a voltage level at said first node drives conduction of said PNP bipolar junction transistor, and electric energy of said external voltage is transmitted through said PNP bipolar junction transistor, so that said triggering signal is generated at said second node and outputted from said dead-time signal catch circuit through said second node.

10. The electronic ballast according to claim 9, wherein before or after said dead time, either said first diode or said second diode is in said on state, and a voltage level at said first node is increased to turn off said PNP bipolar junction transistor, so that said dead-time signal catch circuit stops outputting said triggering signal.

11. The electronic ballast according to claim 6, wherein said power restraining circuit comprises:

a second capacitor connected between an input terminal of said power restraining circuit and a node;

an NPN bipolar junction transistor having a base connected with said input terminal of said power restraining circuit and said second capacitor, and having an emitter connected with said ground terminal; and a sixth resistor having a first end connected with a collector of said NPN bipolar junction transistor, and having a second end connected with an output terminal of said power restraining circuit.

12. The electronic ballast according to claim 11, wherein when said triggering signal is transmitted from said dead-time signal catch circuit to said input terminal of said power restraining circuit, said NPN bipolar junction transistor is in said on state in response to said triggering signal, and said output terminal of said power restraining circuit is connected with said ground terminal through said sixth resistor and said on-state NPN bipolar junction transistor, so that said output terminal of said power restraining circuit issues said restraining signal.

13. The electronic ballast according to claim 12, wherein when said dead-time signal catch circuit stops issuing said triggering signal to said input terminal of said power restraining circuit, said NPN bipolar junction transistor is in said off state, so that said output terminal of said power restraining circuit stops issuing said restraining signal.

14. The electronic ballast according to claim 1, wherein said controlling unit comprises:

a constant power control circuit connected with said converter and said current crest factor improvement circuit, wherein according to said DC voltage and a working DC current from said converter, said constant power control circuit issues said first control signal to control said converter to output a constant power, wherein according to said restraining signal, said first control signal is correspondingly adjusted by said constant power control circuit, so that said output power of said converter is decreased to said predetermined value in real time or said converter is suspended; and an inverter control circuit connected with said inverter circuit for outputting said second control signal and said third control signal to corresponding switch elements of said inverter circuit.

15. An electronic ballast, comprising:

a converter for providing a DC voltage;

an inverter circuit connected with said converter for converting said DC voltage into an AC output voltage, so that at least one gas discharge lamp is driven by electric energy of said AC output voltage, wherein said inverter circuit comprises plural switch elements; and a controlling unit connected with said converter and said plural switch elements of said inverter circuit, wherein said controlling unit issues a first control signal to control said converter and issues a second control signal and a third control signal with opposite enabling/disabling states to control on/off states of corresponding switch elements, wherein during a dead time between said enabling state of second control signal and said enabling state of said third control signal, said plural switch elements are simultaneously in said off state, wherein during said dead time, said first control signal is correspondingly adjusted by said controlling unit, wherein according to said adjusted first control signal, an output power of said converter is decreased to a predetermined value in real time or said converter is suspended.

16. The electronic ballast according to claim 15, wherein said controlling unit comprises:

a constant power control circuit connected with said converter, wherein according to said DC voltage and a working DC current from said converter, said constant power control circuit issues said first control signal to control said converter to output a constant power;

an inverter control circuit connected with said inverter circuit for outputting said second control signal and said third control signal to corresponding switch elements of said inverter circuit; and a current crest factor improvement circuit connected with said inverter control circuit for receiving said second control signal and said third control signal, wherein said current crest factor improvement circuit is further connected with said constant power control circuit for changing said first control signal during said dead time, so that said output power of said converter is decreased to said predetermined value in real time or said converter is suspended.

* * * * *